US009631318B2

(12) United States Patent
Pal, Jr. et al.

(10) Patent No.: US 9,631,318 B2
(45) Date of Patent: Apr. 25, 2017

(54) PRINTABLE RECORDING MEDIA

(71) Applicant: Hewlett-Packard Development Company, L.P., Fort Collins, CO (US)

(72) Inventors: Lokendra Pal, Jr., San Diego, CA (US); John L. Stoffel, San Diego, CA (US); Xulong Fu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/915,015

(22) PCT Filed: Aug. 28, 2013

(86) PCT No.: PCT/US2013/056994

§ 371 (c)(1),
(2) Date: Feb. 26, 2016

(87) PCT Pub. No.: WO2015/030744

PCT Pub. Date: Mar. 5, 2015

(65) Prior Publication Data

US 2016/0222591 A1 Aug. 4, 2016

(51) Int. Cl.

| | |
|---|---|
| ***B41J 2/01*** | (2006.01) |
| ***D21H 17/69*** | (2006.01) |
| ***B41M 5/00*** | (2006.01) |
| ***D21H 17/37*** | (2006.01) |
| ***D21H 17/66*** | (2006.01) |
| ***B41M 5/50*** | (2006.01) |
| ***D21H 17/28*** | (2006.01) |
| ***D21H 21/16*** | (2006.01) |
| ***D21H 21/28*** | (2006.01) |
| ***D21H 23/24*** | (2006.01) |

(52) U.S. Cl.

CPC ..... *D21H 17/69* (2013.01); *B41J 2/01* (2013.01); *B41M 5/0035* (2013.01); *B41M 5/502* (2013.01); *D21H 17/28* (2013.01); *D21H 17/37* (2013.01); *D21H 17/66* (2013.01); *D21H 21/16* (2013.01); *D21H 21/285* (2013.01); *D21H 23/24* (2013.01)

(58) Field of Classification Search

CPC ..... D21H 17/69; D21H 23/24; D21H 17/28; D21H 21/16; D21H 21/285; D21H 17/37; D21H 17/66; B41M 5/502; B41M 5/0035; B41J 2/01

See application file for complete search history.

(56) References Cited

U.S. PATENT DOCUMENTS

| | | | | |
|---|---|---|---|---|
| 5,240,561 | A * | 8/1993 | Kaliski | D21H 17/07 162/138 |
| 6,458,458 | B1 | 10/2002 | Cooke et al. | |
| 6,497,953 | B1 | 12/2002 | Yu et al. | |
| 2003/0021962 | A1 | 1/2003 | Mukherjee et al. | |
| 2005/0244592 | A1 | 11/2005 | Koga et al. | |
| 2007/0087138 | A1 | 4/2007 | Koenig et al. | |
| 2009/0250183 | A1 | 10/2009 | Hayes et al. | |
| 2012/0012264 | A1 | 1/2012 | Zhou et al. | |
| 2012/0194625 | A1 | 8/2012 | Niu et al. | |

FOREIGN PATENT DOCUMENTS

| | | |
|---|---|---|
| WO | 2012089516 | 7/2012 |

OTHER PUBLICATIONS

International Search Report dated May 29, 2014 for PCT/US2013/056994, Applicant Hewlett-Packard Development Company, L.P.

* cited by examiner

*Primary Examiner* — Geoffrey Mruk
(74) *Attorney, Agent, or Firm* — HP Inc. Patent Department

(57) ABSTRACT

A printable recording media having a weight that is below 75 gsm and that contains a blend of hardwood and softwood fibers, wherein the total fiber content is at least 80 wt % of the total weight of the recording media; and a polymeric-modified pigment carbon black in an amount representing from about 0.02 wt % to about 1 wt % of the total weight of the recording media. Also disclosed herein are methods for making the printable recording media and a printing method using the printable recording media.

15 Claims, No Drawings

PRINTABLE RECORDING MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including, low printer noise, capability of high-speed on variable recording and multi-color recording. Within said printing method, the media substrate plays a key role in the overall image quality and permanence of the printed images. Accordingly, investigations continue into developing media that can be effectively used with such printing techniques.

DETAILED DESCRIPTION

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure refers to a printable recording media having a weight that is below 75 gsm and that contains a blend of hardwood fibers and softwood fibers, wherein the total fiber content is at least 80 wt % of the total weight of the recording media; and a polymeric-modified pigment carbon black in an amount representing from about 0.02 wt % to about 1 wt % of the total weight of the recording media.

Said printable recording media are considered as uncoated printable recording media as no coating is applied. The media disclosed herein are also considered as "thin papers". Indeed, the printable recording media has a weight that is below 75 gram per square meter ($g/m^2$ or gsm). The printable recording media can also have a weight ranging from about 45 $g/m^2$ (gsm) to about 65 $g/m^2$ (gsm). In some embodiments, the printable recording media has a weight that is ranging from about 50 $g/m^2$ (gsm) to about 60 $g/m^2$ (gsm).

It is believed that the run-ability of the thin papers disclosed herein is enhanced. For example, printable recording media disclosed herein will exhibit reduced or will eliminate jamming and wrinkling Some examples of the printable recording media are particularly suitable for use in inkjet printing systems. These examples of the media are able to maintain inkjet colorants on the surface and thus exhibit minimal show through. In addition, the printable recording media of the present disclosure has a good feed reliability due to less or no usage of abrasive titanium dioxide particle ($TiO_2$) for example. Furthermore, the printable recording media has an increased opacity while maintaining excellent brightness and whiteness performances. The printable recording media exhibits thus a number of properties that render the thin paper reliable and suitable for a variety of printing techniques. These properties include opacity and brightness.

Examples of the printable recording media disclosed herein may be about 20% thinner and lighter than other commercially available papers (e.g., 16 lbs. compared to 20 lbs.). The thin and light-weight examples disclosed herein offer many advantages. For example, fewer raw materials are utilized to manufacture the thin paper, and the lighter weight of the thin paper may result in lower shipping costs of the paper itself and of brochures and other products made with the paper. Furthermore, thinner paper requires less storage space than thicker paper in cabinets, printer paper trays, briefcases, etc. In addition, laser printers may utilize less power for fusing toner on thinner paper.

In some examples, the printable recording media disclosed herein have an opacity of at least 75%. In some instances, the opacity is 80% or more. Opacity is an optical property of the paper, and may be determined by a ratio of reflectance measurements. TAPPI opacity (i.e., opacity using 89% reflectance backing) is one opacity value that may be used. TAPPI opacity is 100 times the ratio of reflectance of a sample when backed with a black backing to the reflectance of the sample when backed with a white backing having a known reflectance of 89%. The reflectance measurements may be carried out using a brightness and color meter. Examples of the media according to the present disclosure exhibit a normalized opacity of at least 75%. In some other examples, the media according to the present disclosure exhibit a normalized opacity of at least 77. As used herein, "normalized opacity" is the opacity (actual or predicted) multiplied by the target basis weight and divided by the sample basis weight in grams per square meter.

In some examples, the media according to the present disclosure exhibit a normalized TAAPI brightness of at least 80%. In some other examples, the printable recording media has a normalized TAAPI brightness that is at least 82% (on a scale of 1 to 100). The Tappi brightness is measured using TAPPI Standard T452, "Brightness of pulp, paper, and paperboard (directional reflectance at 457 nm)" by means of Technidyne Brightmeter. Measurements are made at 457 nm blue light at a 45° angle and reported. The brightness of the printable recording media is also desirable even though the weight of the paper is reduced. As used herein, "normalized TAAPI brightness" is the TAAPI brightness (actual or predicted) multiplied by the target basis weight and divided by the basis weight in grams per square meter.

The recording media may take the form of a media sheet or a continuous web suitable for use in an inkjet printer. The recording media is produced from chemical pulp, mechanical pulp or from pulps resulting from hybrid processes, such as thermo-mechanical pulp (TMP) and chemio-thermomechanical pulps (CTMP). The recording media includes cellulose fibers that can be made from hardwood or softwood species. In some examples, hardwood fibers may have an average fiber length between about 0.5 to about 3 mm and softwood fibers may have an average length between about 3 and about 7 mm.

Examples of the recording media include a blend of hardwood fibers and softwood fibers referred herein as the paper base stock. Examples of suitable hardwood fibers include pulp fibers derived from deciduous trees (angiosperms), such as birch, aspen, oak, beech, maple, and eucalyptus. Examples of suitable softwood fibers include pulp fibers derived from coniferous trees (gymnosperms), such as varieties of fir, spruce, and pine (e.g., loblolly pine, slash pine, Colorado spruce, balsam fir, and Douglas fir). In some examples, the recording media includes a blend of International Paper northern USA hardwood fibers and International Paper southern USA softwood fibers.

The printable recording media includes a blend of hardwood and softwood fibers and wherein a total fiber content of, at least, about 80 wt % of the total weight of the recording media. "Wt %", as used herein, refers to dry weight percentage based on the total dry weight of the media. The total fiber content is equal to 100 wt % minus total filler wt % minus wt % of any other ingredients, including, for example, sizing agents, starch, and salt. In an example, the total fiber content ranges from about 85 wt % to about 92 wt %.

In some examples, the ratio of hardwood to softwood fibers can range from 100:0 down to 30:70. In some other examples, the ratio of hardwood fibers to softwood fibers used ranges from about 70/30 to about 30/70 by weight. The blend of hardwood and softwood fibers may be prepared via any known pulping process, such as, for example, chemical pulping processes. In some examples, the hardwood and softwood fibers are chemically pulped fibers. Suitable chemical pulping methods include the Kraft, sulfite, neutral sulfite and the soda process. In some other examples, some of the hardwood and softwood fibers are chemically pulped fibers and some of the hardwood and softwood fibers are mechanically pulped fibers. In yet some other examples, the amount of chemically pulped fibers is at least 90 wt % of the total fiber content, and the amount of mechanically pulped fibers is up to 10 wt % of the total fiber content.

The recording media can include both cellulose fibers and synthetic fibers. The use of synthetic fiber might improve dimension stability and reduce moisture absorption when excessive aqueous ink vehicle is jetted on the receiving materials. The synthetic fibers can be made by polymerization of organic monomers. The synthetic fibers include fibers formed from polyolefins, polyamides, polyesters, polyurethanes, polycarbonates and polyacrylics. Other examples of the synthetic organic fibers made from polyolefins or polyolefin copolymers include polyethylene fibers, polyethylene copolymer fibers, polypropylene fibers, polyethylene copolymer fibers, or polypropylene copolymer fibers. Polyethylene or polypropylene copolymers may refer to the copolymers of ethylene and/or propylene with linear alkenes such as 1-butene, 1-hexene, 1-octene, 1-decene, 1-dodecene, 1-tetradecene, 1-hexadecene and 1-octadecene. Polyethylene or polypropylene copolymers can also refer to the copolymers of ethylene and/or propylene with branched alkenes, such as isobutene. Ethylene copolymer can be ethylene with vinyl acetate and with partial or complete hydrolysis products, such as polyvinyl alcohol fibers. In some examples, the content of the synthetic fiber is from about 3 to about 50 wt % of the total fiber weight or could be in the range of about 5 to about 20 wt % of total fiber weight. In some other examples, the content of the synthetic fiber is from about 5 to about 10 wt % of the total fiber weight.

Fillers may also be incorporated into the blend of hardwood fibers and softwood fibers, for example, to substantially control physical properties of the final media. The filler particles may fill in the void spaces of the fiber network and result in a denser, smoother, brighter and opaque sheet. Examples of the fillers include, but are not limited to, ground calcium carbonate, precipitated calcium carbonate, titanium dioxide, kaolin clay, silicates, plastic pigment, alumina trihydrate, and/or mixtures thereof.

In some examples, the printable recording media, as described herein, comprises fillers in an amount representing from about 3 wt % to about 25 wt % of the total weight of the recording media. In some other examples, fillers can be present in an amount representing from about 7 wt % to about 15 wt % of the total weight of the recording media. The recording media may include from about 60 lbs. of filler per ton of paper to about 200 lbs. of filler per ton of paper (i.e., from about 27 kg of filler per ton of paper to about 91 kg per ton of paper).

Examples of suitable fillers include precipitated calcium carbonate, ground calcium carbonate, talc, clay (e.g., calcined clay, kaolin clay, or other phyllosilicates), calcium sulfate, titanium dioxide ($TiO_2$) or combinations thereof. An example of suitable filler is precipitated calcium carbonate. Precipitated calcium carbonate can be commercially available, for example, under the tradenames Opacarb®A40 and Albacar®hodry (both available from Minerals Technologies Inc.). Ground calcium carbonate is commercially available, for example, under the trade names Omyafil , Hydrocarb 70 and Omyapaque®, (all of which are available from Omya North America). Examples of commercially available filler clays are Kaocal®, EG-44, and B-80 (available from Thiele Kaolin Company). An example of commercially available talc is Finntalc®F03 (available from Mondo Minerals).

The printable media of the present disclosure encompasses a polymeric modified pigment carbon black. Such polymeric modified pigment carbon black is present in an amount representing from about 0.02 wt % to about 1 wt % of the total weight of the printable recording media.

In one aspect, the polymeric-modified pigment carbon black can be added to the blend of hardwood and softwood fibers in the wetend (wetend application). In other word, the polymeric-modified pigment carbon black can be added to the blend of hardwood and softwood fibers (pulp suspension) before the fibers are converted to a paper web or substrate. In another aspect, the polymeric-modified pigment carbon black can be added as a surface sizing agent to the formatted paper roll by film size press, pond size press and/or other surface treatment techniques (size press application). When applied via size press application, i.e. as a surface sizing agent, the polymeric-modified pigment carbon black will be part of a surface sizing solution (or surface treatment composition). In some examples, the polymeric-modified pigment carbon black is added as a surface sizing agent and is part of a surface sizing solution containing starch additives. In other word, the addition of the polymeric-modified pigment carbon black can take place, on the one hand, before the sheet formation in the paper pulp (internal application) and, on the other hand, after the sheet formation in the size press In some examples, the polymeric modified carbon black pigment is a self-dispersed black pigment that is modified to include at least one polymer chemically attached thereto. Such modified carbon black pigment may be formed by combining the carbon black pigment with polymers containing carboxylic groups. Non-limiting examples of carboxylic groups include styrene-acrylic polymers, polyacrylic acid polymers, polymethacrylic acid polymers, and styrene maleic anhydride polymers. Suitable styrene-acrylic acid polymers include, but are not limited to, polystyrene-acrylic acid, polystyrene-methacrylic acid, and/or the like, and/or combinations thereof In some embodiments, the polymeric-modified pigment carbon black is formed by combining a carbon black pigment with polymers containing carboxylic groups selected from the group consisting of styrene-acrylic polymers, polyacrylic acid polymers, polymethacrylic acid polymers and styrene maleic anhydride polymers.

Representative examples of black pigments include various carbon blacks such as channel blacks, furnace blacks and lamp blacks. Representative examples of black pigments include carbon blacks sold under the trademarks: Regal®, Black Pearls®, Elftex®, Monarch®, Mogul®, Vulcan® (available from Cabot Corporation). Specific examples of black pigments include Black Pearls® 2000, Black Pearls® 1400, Black Pearls® 1300, Black Pearls® 1100, Black Pearls® 1000, Black Pearls® 900, Black Pearls® 880, Black Pearls® 800, Black Pearls® 700, Black Pearls® L, Elftex® 8, Monarch® 1400, Monarch® 1300, Monarch® 1100, Monarch® 1000, Monarch® 900, Monarch® 880, Monarch® 800, Monarch® 700, Mogul® L, Regal® 330, Regal® 400, Vulcan® P.

The polymeric modified carbon black pigment can be prepared by combining, in any order, at least one pigment having attached at least one nucleophilic group, at least one polymer comprising at least one carboxylic acid group or salt thereof, and at least one coupling agent. The polymer and coupling agent can be combined to form a reactive polymer, and the reactive polymer can be combined with the pigment having attached at least one nucleophilic group. Such process can be done in an aqueous environment. The nucleophilic group used for making the polymeric modified carbon black pigment can be any group capable of forming a polymer-modified pigment when combined with a polymer comprising at least one carboxylic acid group and a coupling agent. The nucleophilic group may comprise an amine, a hydrazine, an alcohol, a thiol, a hydrazide, an oxime, or salts and derivatives thereof. Examples of general classes of polymeric groups include, but are not limited to, polyamines, polyethers (such as polyalkyleneoxides), polyols (such as polyhydroxybenzene, polyvinyl alcohol, and acrylic polyols), polymers containing sulfur (such as polysulfide and polyphenylene sulfide), acrylic polymers, polyamides, and polyurethanes. The reactive polymer includes, at least, one carboxylic acid group and a coupling agent. The polymer may be a homopolymer or copolymer containing any number of different repeating units, any of which comprise at least one carboxylic acid group or salt thereof. In some examples, the polymer including at least one carboxylic acid group is polyurethane, polyester, polyamide, or a homo- or copolymer of acrylic acid, methacrylic acid, maleic acid, or salts thereof. Examples of polymers include polyacrylic acid, polymethacrylic acid, poly(styrene-acrylic acid), poly(styrene-methacrylic acid), poly(styrene-maleic acid), copolymers of acrylic acid or methacrylic acid and alkyl acrylates or methacrylates, poly(ethylene-acrylic acid), or salts thereof. The coupling agent is a material which couples the pigment and the polymer by activating the carboxylic acid groups toward nucleophilic addition. Examples of classes of coupling agents include anhydrides, acyl halides, chloroformates, carbodiimides, triazines containing leaving groups, and carbamoylpyridinium, phosphonium, and uronium salts. Reagents such as dehydrating agents, condensation agents, esterification agents, or amidation agents known to one skilled in the art for activating carboxylic acid groups may also be used. Examples of coupling agents includes, for examples, acetic anhydride, diphenylphosphorylazide, 1-ethyl-3-(3-dimethylaminopropyl)carbodiimide (EDAC), 1,3-dicyclohexylcarbodiimide, 1,3-diispropylcarbodiimide, N,N-carbonyldiimidazole, isobutyl chloroformate, 1-methyl-2-chloropyridinium iodide or (4-dimethylcarbamoyl-pyridyl)sulfonate inner salt.

The polymeric modified pigment carbon black can also be made via a diazonium reaction. Such process involves the reaction of at least one diazonium salt with a carbon black pigment. A diazonium salt is an organic compound having one or more diazonium groups. Diazonium salts may be formed, for example, by the reaction of primary amines with aqueous solutions of nitrous acid. The diazonium salt may contain an organic group to be attached to the carbon black pigment. The organic group may be an aliphatic group, a cyclic organic group, or an organic compound having an aliphatic portion and a cyclic portion. The organic group may be substituted or unsubstituted, branched or unbranched. Aliphatic groups include, for example, groups derived from alkanes, alkenes, alcohols, ethers, aldehydes, ketones, carboxylic acids, and carbohydrates. Cyclic organic groups include, but are not limited to, alicyclic hydrocarbon groups, heterocyclic hydrocarbon groups, aryl groups, and heteroaryl groups.

The polymeric modified pigment carbon black can also be made by combining, in any order, a black pigment having attached an electrophilic group and a thiol reagent comprising at least one —SH group and at least two ionic or ionizable groups. The thiol reagent can be an alkylthiol substituted with at least two carboxylic acid groups. The pigment having attached an electrophilic group might also be combined with a thiopolymer comprising at least one —SH group and at least one ionic or ionizable group. The thiopolymer might encompass the reaction product of a polymer having at least one anhydride, at least one activated carboxylic acid, or at least one carboxylic acid or salt thereof; an aminoalkane thiol or an aromatic amino thiol; and optionally an activating agent.

The printable media of the present disclosure can encompass optical brightener agents in an amount representing from about 0.1 wt % to about 3 wt % of the total weight of the media. The optical brightener can also be present in an amount representing from about 0.5 wt % to about 2.5 wt % of the total weight of the printable media. Optical brightener agents (or brightening agents) are dye-like fluorescent compounds which absorb the short-wave ultraviolet light not visible to the human eye and emit it as longer-wave blue light, with the result that the human eye perceives a higher degree of whiteness and the degree of whiteness is thus increased. This provides added brightness and can offset the natural yellow cast of a substrate such as paper. Illustrative examples of useful optical brightener agents are 4,4'-bis-(thazinylamino)-stilbene-2,2'-disulfonic acids, 4,4'- bis-(thazol-2-yl)stilbene-2,2'-disulfonic acids, 4,4'-dibenzofuranyl-biphenyls, 4,4'-(diphenyl)-stilbenes, 4,4'-distyrylbiphenyls, 4-phenyl-4'-benzoxazolyl-stilbenes, stilbenyl-naphthothazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides. In some examples, the optical brightener agents used in the printable recording media of the present disclosure can be based on stilbene chemistry such as 1,3,5- triazinyl derivatives of 4,4'-diaminostilbene-2,2'-disulfonic acid and salts thereof, which may carry additional sulfo groups, as for example at the 2, 4 and/or 6 positions. Examples of commercially available OBA stilbene derivatives are, for instance, those commercially available from Ciba Geigy under the tradename "Tinopar", from Clariant under the tradename "Leucophor®", from Lanxess under the tradename "Blankophor®", and from 3V under the tradename "Optiblanc®" such as disulfonate, tetrasulfonate and hexasulfonate stilbene based optical brightener agents.

The optical brightener agent (OBA) can be added to the blend of fibers, fillers and other functional additives or to the stock in the wetend. In other word, it can be added to the pulp suspension before it is converted to a paper web or substrate. The optical brightener agent can be added, for example, to the cellulosic fibers in the pulp during or after the refining step, prior to adding any additional wet end chemicals. Thus, in some examples, the printable recording media includes optical brightener agents that are added to the blend of hardwood and softwood fibers, as an additive.

Alternatively, the optical brightener agent (OBA) can be added as a surface additive to the formatted paper roll by film size press, pond size press and other surface treatment techniques (size press application). When applied via size press application, i.e. as a surface additive, optical brightener agents (OBA) will be part of a surface sizing composition.

The printable recording media of the present disclosure may encompass salts in an amount representing from about 0.1 wt % to about 5 wt % of the total weight of the media. Such salts can be bi-valent and/or multi-valent salts. The bi-valent and/or multi-valent salt can also be present in an amount representing from about 0.4 wt % to about 1 wt % of the total weight of the printable media. In some examples, such salt may be added in any amount ranging from about 2000 μg/gram of paper to about 9500 μg/gram of paper. Such salt will be thus added to the recording media during the paper making process at the size press.

Examples of suitable salts include calcium chloride ($CaCl_2$), magnesium chloride ($MgCl_2$), aluminum chloride ($AlCl_3$), magnesium sulfate ($MgSO_4$), calcium acetate, calcium propionate, calcium nitrate and combinations thereof. In some examples, the printable recording media encompasses calcium chloride ($CaCl_2$) as a bi-valent salt. Without being linked by any theory, it is believed that the addition of salt may provide the recording media with the ability to maintain colorants (e.g., present in inkjet inks) at the surface of the recording media, thereby improving show through (i.e., strikethrough, or the amount of ink printed on one side of the paper that can be seen through the other side of the paper) as well as other printing qualities (black optical density, color saturation, etc.).

In some embodiments, a method for making the printable recording media includes: mixing a blend of hardwood fibers and softwood fibers with a polymeric-modified pigment carbon black in view of forming a pulp; pressing the pulp into a raw base paper; and removing water in view of obtaining a printable recording media such as described herein.

The water can be removed from the raw based paper by filtration, by pressing and/or drying means. In some examples, fillers and other additives, such as optical brightener agents, salts and retention aids, are added to the mixture containing the blend of fibers and the polymeric-modified pigment carbon black. In some examples, the blend of hardwood and softwood fibers is mixed with polymeric-modified pigment carbon black and with optical brightener agents. In some other examples, the blend of hardwood and softwood fibers is mixed with polymeric-modified pigment carbon black, with optical brightener agents and with fillers.

The fiber mix (blend of hardwood fibers and softwood fibers) is mixed with the polymeric-modified pigment carbon black and, when present, fillers and other additives, and is formed in a web on a paper machine. The raw base paper can be calendered, after the drying step, in view of obtaining the printable recording media.

When preparing the blend of hardwood fibers and softwood fibers (i.e. paper base stock), internal and/or surface sizing may be used. Internal sizing may be accomplished by adding a sizing agent, in addition to the polymeric-modified pigment carbon, to the raw base blend of fibers in the wet end. The sizing agents can thus be added to the blend of fibers that has the form of a pulp suspension, before it is converted to a paper web or substrate. Non-limitative examples of suitable sizing agents include rosin-based sizing agent(s), wax-based sizing agent(s), cellulose-reactive sizing agent(s) and other synthetic sizing agent(s), and/or mixtures. The type and amount of surface sizing agent(s) used may substantially improve moisture resistance and may alter the stiffness of the base paper stock.

In some other embodiments, a method of making the printable recording media includes: obtaining a raw base paper by mixing a blend of hardwood and softwood fibers in view of forming a fiber mat; pressing the fiber mat into a raw base paper; pre-drying the raw base paper; applying a surface sizing solution containing starch additives and polymeric-modified pigments carbon black, onto the raw base paper via a size press; and drying the raw base paper in view of obtaining the printable recording media such as described herein.

The raw base paper can also be obtained by mixing a blend of hardwood and softwood fibers with fillers, in view of forming a fiber mat. The raw base paper can further be calendered in view of obtaining the printable recording media. The surface sizing solution (or surface treatment composition) contains starch additives and polymeric-modified pigment carbon black as surface sizing agents. In some other examples, the surface sizing solution contains starch additives, polymeric-modified pigment carbon black and optical brightener agents as surface sizing agent. In yet some other examples, the surface sizing solution contains starch additives, polymeric-modified pigment carbon black, optical brightener agents and bi-valent and/or multi-valent salts as surface sizing agent. The surface sizing solution may also contain optical brightener agent carrier such as polyvinyl alcohol for instance. The application of the surface sizing solution to the raw base paper (i.e. surface sizing step) may be accomplished by film size press, pond size press and other surface techniques.

The surface sizing composition includes starch additives. The starch additives may be of any type, including but not limited to oxidized, ethylated, cationic and pearl starch. In some examples, the starch is used in an aqueous solution. Illustrative of useful starches are naturally occurring carbohydrates synthesized in corn, tapioca, potato and other plants by polymerization of dextrose units. Suitable starches that can be used herein are modified starches such as starch acetates, starch esters, starch ethers, starch phosphates, starch xanthates, anionic starches, cationic starches and the like which can be derived by reacting the starch with a suitable chemical or enzymatic reagent. in some examples, the starch additives can be native starch, or modified starches(enzymatically modified starch or chemically modified starch). In some other examples, the starches are cationic starches and chemically modified starches. Useful starches may be prepared by known techniques or Obtained from commercial sources. Examples of suitable starches include Penfbrd Gum-280 (commercially available from Penford Products), SLS-280 (commercially available from St. Lawrence Starch), the cationic starch CatoSize 270 (from National Starch) and the hydroxypropyl No. 02382 (from Poly Sciences). In some examples, a suitable size press/surface starch additive is 2-hydroxyethyl starch ether, which is commercially available under the tradename Penford®Gum 270 (available from Penford Products). When used as surface ingredient, the starch additive will be present in an amount ranging from about 1 wt % to about 15 wt % based on the total weight of the surface sizing composition. The surface sizing composition might thus further include bi-valent and/or multi-valent salts. In some examples, the surface sizing composition might further include calcium chloride ($CaCl_2$) as bivalent salt. Such salt can represent from about 0.1 wt % to about 5 wt % based on the total weight of the surface sizing composition.

In some examples, the printable recording media of the present disclosure encompasses a polymeric-modified pigment carbon black that is applied to the blend of hardwood fibers and softwood fibers (raw base paper) with a surface sizing composition comprising starch additives. In some other examples, the printable recording media encompasses a polymeric-modified pigment carbon black that is applied to the blend of hardwood fibers and softwood fibers (raw base paper) with a surface sizing composition comprising starch additives and optical brightener agents. In yet some other examples, the printable recording media encompasses a polymeric-modified pigment carbon black that is applied to the blend of hardwood fibers and softwood fibers (raw base paper) with a surface sizing composition comprising starch additives, optical brightener agents and bi-valent salts.

The printable recording media may be made using any suitable paper making process. It is to be understood that the process used does not deposit any coating on the recording media, rather the various ingredients are processed to form single sheets of thin paper or a continuous web of thin paper. The printable recording media can be formed, for example, on a Fourdrinier paper machine. The Fourdrinier paper machine consists of a head box that delivers a stream of dilute fibers and other papermaking ingredients on to a continuously moving wire belt. The water drains through the wire belt, thereby forming a wet mat of fibers. The mat is then pressed and dried.

In some examples, the fiber mix (blend of hardwood fibers and softwood fibers) can be pre-made into raw base and a starch based surface sizing composition containing polymeric-modified pigment carbon black and, when present, optical brightener agents are added at the size press stage. In some other examples, the fiber mix (blend of hardwood fibers and softwood fibers) can be pre-made into raw base and a starch based surface sizing composition containing polymeric-modified pigment carbon black, optical brightener agents and salts, is added at the size press stage. Any conventional size treatment method and apparatus can be used. Methods and apparatuses for treating a media with a sizing composition are well known in the art. See for example "Handbook for Pulp & Paper Technologies", 2nd Edition, G. A. Smook, Angus Wilde Publications (1992) and references cited therein. By way of example, the surface sizing composition may be applied from a size press that can be any type of coating or spraying equipment, such as, for examples, a puddle, gate roller or metered blade type of size press. The media can then be dried after treatment with the size composition using any drying method and apparatus. After drying, the recording media may be subjected to one or more post drying operations: the media may for example, be calendered in order to improve its smoothness. The calendering may be accomplished by steel-steel calendaring at nip pressures sufficient to provide a desired caliper.

Examples of the printable recording media (or thin paper) disclosed herein may be printed using a variety of printing techniques, including laser printing and inkjet printing. Printing may be accomplished in the typical manner, where the thin paper is fed into the selected printer, and toner or ink is applied thereto. When printing on printable recording media, it is to be understood that a printing mode that utilizes less energy may be used. For example, some laser (i.e., laser jet, enterprise) printers are capable of detecting the thin paper and automatically initiating an energy savings printing mode that uses a lower temperature for fusing than a printing mode used for higher weight paper. While the printable recording media (or thin paper) is actually being printed on in the energy savings printing mode, the overall energy savings may range from about 4% to about 6%.

The printing method encompasses obtaining a printable media having a weight that is below 75 gsm and that contains a blend of hardwood fibers and softwood fibers in an amount of at least 80 wt % and a polymeric-modified pigment carbon black in an amount representing from about 0.02 wt % to about 1 wt % of the total weight of the recording media; then, applying an ink composition onto said media, to form a printed image. The printable media can receive any inkjet printable ink, such as, for example, organic solvent-based inkjet inks or aqueous-based inkjet inks.

The ink composition may be deposited, established, or printed on the printable media using any suitable printing device. In some examples, the ink composition is applied to the printable media via inkjet printing techniques. The ink may be deposited, established, or printed on the media via continuous inkjet printing or via drop-on-demand inkjet printing, which includes thermal inkjet printing and piezoelectric inkjet printing. Some examples of inkjet inks that may be deposited, established, or otherwise printed on the printable media of the present disclosure include pigment-based inkjet inks, dye-based inkjet inks, pigmented latex-based inkjet inks, and UV curable inkjet inks Additionally, the printable media are also designed to receive thereon a solid toner or a liquid toner. The solid toner or the liquid toner may include toner particles made, e.g., from a polymeric carrier and one or more pigments. The liquid toner may be an organic solvent-based (e.g., hydrocarbon) liquid toner. The solid toner or the liquid toner may be deposited, established, or otherwise printed on the examples of the printable media using, respectively, a suitable dry or liquid press technology, such as a dry toner electrophotographic printing device or a liquid toner electrophotographic printing device.

EXAMPLES

1. Samples Making Process and Formulations a. Fiber Furnish Pre-Mix

Different recording media samples are prepared having a fiber mix (raw base paper) according to the specifications outlined in Table 1 below. Each media samples contain a blend of 60% hardwood Kraft pulp fibers, 30% softwood Kraft pulp fibers and 10% thermo-mechanical pulp (TMP) fibers. Pre-refined pulp slurries of each pulp are obtained from Western Michigan University Pilot Plants Facility.

TABLE 1

| Pre-mix Furnish | Consistency (Solids %) | Parts |
|---|---|---|
| Hardwood | 1.70% | 60 |
| Softwood | 1.73% | 30 |
| TMP | 3.25% | 10 |
| Total | 1.83% | 100 |

Polymeric-modified pigment carbon black and optical brightener agent (Tinopal® available from BASF) are then added in to the fiber mix shown in Table 1. Table 2 illustrates the solid content (in %) of each ingredient.

TABLE 2

| Chemicals | Furnish Pre-Mix | Polymeric-Modified Pigment Carbon Black | Tinopal ® |
|---|---|---|---|
| Solids (%) | 1.83% | 15.05% | 35.54% |

b. Media Prepared With Wetend (Internal) Application

The media samples 1 to 10 are prepared by adding the polymeric treated carbon black pigment and optical brightener agent in the fiber mix in a wetend internal application. The final mix is diluted to 0.6% consistency (solids %) and 200 mL of the solution is used to make the handsheet using a standard 159 mm diameter sheet machine with target basis weight of 60 gsm. The quantity of ingredients added in each media samples and the final basis weight (in gsm) are illustrated in Table 3 below.

TABLE 3

| Formulation ID | Furnish Recipe (dry parts) | Polymeric Treated Carbon Black Pigment (dry parts) | OBA (dry parts) | Basis wt (gsm) |
|---|---|---|---|---|
| Sample 1 | 100 | — | — | 63.3 |
| Sample 2 | 100 | 0.05 | — | 60.3 |
| Sample 3 | 100 | 0.1 | — | 59.8 |
| Sample 4 | 100 | 0.2 | — | 61.0 |
| Sample 5 | 100 | 0.05 | 0.5 | 58.8 |
| Sample 6 | 100 | 0.1 | 0.5 | 62.5 |
| Sample 7 | 100 | 0.2 | 0.5 | 62.8 |
| Sample 8 | 100 | 0.05 | 1 | 62.3 |
| Sample 9 | 100 | 0.1 | 1 | 61.0 |
| Sample 10 | 100 | 0.2 | 1 | 61.0 |

c. Media Prepared With Surface Sizing Formulation

Surface sizing compositions (a) to (f) are prepared according to the formulations listed in Table 4. All ingredients are illustrated according to their dry parts. Surface sizing compositions (a) to (f) are prepared by adding a starch solution into container containing water and mixing it for about 2 minutes. Starch (Penford®Gum 280 available from Penford Products) is cooked separately in water for 20 min at 90° C. with agitation. The polymeric modified pigment carbon black is then added and mixed for 1 to 2 minutes. When present, optical brightener agents and $CaCl_2$ are added separately and mixed independently for 1 to 2 minutes. Surface sizing compositions (a) to (f) are then applied to the sheets of 60 gsm raw base paper as outlined in Table 1, using a Mayer rod#8 size press, and dried using heat gun for 1 min. Media samples A to F are then obtained accordingly.

TABLE 4

| Surface Sizing Formulations | (a) | (b) | (c) | (d) | (e) | (f) |
|---|---|---|---|---|---|---|
| Penford ® Gum 280 | 100 | 100 | 100 | 100 | 100 | 100 |
| Polymeric Modified Pigment Carbon Black | — | 0.1 | 0.3 | 0.5 | 0.1 | 0.5 |
| Tinopal ® | — | — | — | — | 0.5 | 0.5 |
| CaCl2 | — | — | — | — | 15 | 15 |
| Total Parts | 100 | 100.1 | 100.3 | 100.5 | 115.6 | 116 |
| Solids (%) | 4.84 | 4.67 | 4.58 | 4.66 | 5.08 | 4.64 |
| Brookfield Viscosity (cP), S62, 100 rpm | 47.1 | 38.1 | 39 | 35.4 | 24 | 21.3 |

2. Media Performances

The media samples 1 to 10 and A to F are evaluated for their Brightness and Opacity. TAPPI Brightness is measured using TAPPI Standard T452, "Brightness of pulp, paper and paperboard (directional reflectance at 457 nm)". The opacity is tested using TAPPI test method T425. In accordance with this test method, a reflectance measurement is made on a sheet of paper backed by a black backing, $R_0$. Another reflectance measurement is made on the sheet backed by an 89% reflective tile, $R_{0.89}$. Opacity=$100\times R_0/R_{0.89}$. Higher opacity values indicate that it is more difficult to see through the sheet of paper. The "normalized opacity" or "normalized brightness" are obtained from the opacity or brightness multiplied by target basis weight (here, 60 gsm plain paper sheet) and divided by the actual basis weight in grams per square meter.

Table 5 illustrates performance results for media samples 1 to 10 (i.e. obtained when ingredients are added in wetend).

Table 6 illustrates performance results for media samples A to H (obtained when ingredients are added on surface application). The applied weight of the Polymeric Modified Pigment Carbon Black, Tinopal (OBA) and CaCl2 are calculated based on the total pickup as shown in the Table 6.

TABLE 5

| Sample ID | Normalized Opacity (%) | Normalized Tappi Brightness (%) Front | Back |
|---|---|---|---|
| Sample 1 | 76.4 | 80.0 | 80.0 |
| Sample 2 | 79.1 | 83.6 | 83.5 |
| Sample 3 | 80.2 | 82.1 | 82.2 |
| Sample 4 | 79.8 | 79.2 | 79.6 |
| Sample 5 | 80.3 | 92.3 | 92.0 |
| Sample 6 | 76.8 | 85.0 | 85.0 |
| Sample 7 | 77.6 | 83.0 | 82.7 |
| Sample 8 | 77.6 | 85.8 | 86.2 |
| Sample 9 | 78.7 | 87.0 | 87.1 |
| Sample 10 | 79.2 | 85.6 | 85.8 |

TABLE 6

| Media | Polymeric Modified Carbon Black (gsm) | Tinopal ® (gsm) | CaCl2 (gsm) | Opacity (%) | Tappi Brightness (%) |
|---|---|---|---|---|---|
| Sample A | 0 | 0 | 0 | 82.7 | 93.1 |
| Sample B | 0.002 | 0 | 0 | 83.0 | 93.7 |
| Sample C | 0.011 | 0 | 0 | 83.7 | 93.0 |
| Sample D | 0.024 | 0 | 0 | 84.0 | 92.5 |
| Sample E | 0.004 | 0.021 | 0.636 | 82.9 | 93.7 |
| Sample F | 0.013 | 0.013 | 0.392 | 83.8 | 92.6 |

The invention claimed is:

1. A printable recording media having a weight that is below 75 gsm, comprising:

a. a blend of hardwood fibers and softwood fibers, wherein the total fiber content is at least 80 wt % of the total weight of the media;

b. and a polymeric-modified pigment carbon black in an amount representing from about 0.02 wt % to about 1 wt % of the total weight of the media.

2. The printable recording media according to claim 1 wherein the polymeric modified carbon black pigment is a self-dispersed black pigment that is modified to include at least one polymer chemically attached thereto.

3. The printable recording media according to claim 1 wherein the polymeric-modified pigment carbon black is formed by combining a carbon black pigment with polymers containing carboxylic groups selected from the group consisting of styrene-acrylic polymers, polyacrylic acid polymers, polymethacrylic acid polymers and styrene maleic anhydride polymers.

4. The printable recording media according to claim 1, further comprising optical brightener agents in an amount representing from about 0.1 wt % to about 3 wt % of the total weight of the recording media.

5. The printable recording media according to claim 1, further comprising bi-valent and/or multi-valent salts in an amount representing from about 0.1 wt % to about 5 wt % of the total weight of the recording media.

6. The printable recording media according to claim 1, further comprising fillers in an amount representing from about 3 wt % to about 25 wt % of the total weight of the media.

7. The printable recording media according to claim 1 wherein the polymeric-modified pigment carbon black is added to the blend of hardwood and softwood fibers in the wet end.

8. The printable recording media according to claim 1 wherein the polymeric-modified pigment carbon black is added to the blend of hardwood and softwood fibers as a surface sizing agent and is part of a surface sizing solution containing starch additives.

9. The printable recording media according to claim 1 wherein the polymeric-modified pigment carbon black is added to the blend of hardwood and softwood fibers as a surface sizing agent and is part of a surface sizing solution containing starch additives and optical brightener agents.

10. A method for making the printable recording media as described in claim 1, comprising:

a. mixing a blend of hardwood fibers and softwood fibers with a polymeric-modified pigment carbon black in view of forming a pulp;

b. pressing the pulp into a raw base paper;

c. and removing water in view of obtaining the printable recording media.

11. The method according to claim 10 wherein optical brightener agents are added to the mix of hardwood and softwood fibers and polymeric-modified pigment carbon black.

12. A method for making the printable recording media as described in claim 1, comprising:

a. obtaining a raw base paper by mixing a blend of hardwood and softwood fibers in view of forming a fiber mat;

b. pressing the fiber mat into a raw base paper;

c. pre-drying the raw base paper;

d. applying a surface sizing solution containing starch additives and polymeric-modified pigment carbon black onto the raw base paper via a size press;

e. drying the raw base paper in view of obtaining the printable recording media.

13. The method according to claim 12 wherein the surface sizing solution further encompasses optical brightener agents.

14. The method according to claim 12 wherein the surface sizing solution further encompasses optical brightener agents and bi-valent and/or multi-valent salts.

15. A printing method for the printable recording media as defined in claim 1, the method comprising:

a. obtaining a media having a weight that is below 75 gsm and that contains a blend of hardwood fibers and softwood fibers in an amount of at least 80 wt % and a polymeric-modified pigment carbon black in an amount representing from about 0.02 wt % to about 1 wt % of the total weight of the recording media;

b. applying an ink composition onto said media to form a printed image.

* * * * *